US005797240A

United States Patent [19]

Martin-Cocher et al.

[11] Patent Number: 5,797,240

[45] Date of Patent: Aug. 25, 1998

[54] METHOD OF WRAPPING LOADS BY MEANS OF A STRETCHABLE FILM, A MACHINE AND A FILM FOR IMPLEMENTING THE METHOD

[75] Inventors: Jean-Paul Martin-Cocher, Servolex; Georges Jaconelli, Brison-Saint-Innocent, both of France

[73] Assignee: Newtec International, Viroflay, France

[21] Appl. No.: 387,711

[22] PCT Filed: Aug. 25, 1993

[86] PCT No.: PCT/FR93/00827

§ 371 Date: Aug. 29, 1995

§ 102(e) Date: Aug. 29, 1995

[87] PCT Pub. No.: WO94/04419

PCT Pub. Date: Mar. 3, 1994

[51] Int. Cl.[6] ..... B65B 13/02; B65B 53/00

[52] U.S. Cl. ..... 53/399; 53/441; 53/556; 53/586; 53/587; 53/588; 242/160.4; 242/419.5

[58] Field of Search ..... 264/71, 73, 288.4; 242/160.1, 160.4, 419.5, 613.1, 918; 53/399, 441, 556, 586, 587, 588, 141, 389.4

[56] References Cited

U.S. PATENT DOCUMENTS

| | | | |
|---|---|---|---|
| 3,737,030 | 6/1973 | Stewart | 242/613.1 X |
| 4,242,297 | 12/1980 | Dacey et al. | 242/160.4 X |
| 4,503,658 | 3/1985 | Mouser et al. | 53/441 |
| 5,027,581 | 7/1991 | Kovacs | 53/399 |
| 5,307,609 | 5/1994 | Kurata et al. | 53/441 X |
| 5,458,841 | 10/1995 | Shirrell | 53/556 X |

FOREIGN PATENT DOCUMENTS

| | | |
|---|---|---|
| 0096635 | 12/1986 | European Pat. Off. . |
| 293352 | 5/1988 | European Pat. Off. . |
| 2281275 | 8/1974 | France . |
| 2499020 | 8/1981 | France . |
| 2579577 | 8/1990 | France . |
| 3409117 | 9/1985 | Germany . |

*Primary Examiner*—Linda Johnson
*Attorney, Agent, or Firm*—Schwartz & Weinrieb

[57] ABSTRACT

A method and a machine for wrapping loads of items grouped together in a bundle that may be palletized or otherwise, by means of a stretchable film put into place around the bundle and, where appropriate, a pallet, after the film has been pre-stretched and paid out from a spool or the like on which it is stored in the pre-stretched state with an elongation value of about 150% to 500% and a tension, after relaxation, lying in the range 2 to 7, and preferably in the range 2 to 3 daN/mm$^2$ of film section per turn.

24 Claims, 5 Drawing Sheets

METHOD OF WRAPPING LOADS BY MEANS OF A STRETCHABLE FILM, A MACHINE AND A FILM FOR IMPLEMENTING THE METHOD

FIELD OF THE INVENTION

The invention relates to a method of wrapping loads in stretchable film, and to a machine and a film for implementing the method. More particularly, the invention relates to wrapping palletized loads, but it is not limited to that particular application insofar as it can be used for wrapping loads of articles brought together without a pallet.

BACKGROUND OF THE INVENTION

It is known that palletized or other loads can be wrapped in stretchable film by using a film, generally of polyethylene, that has a thickness lying in the range 12 microns to 150 microns and more generally in the range 20 microns to 30 microns, which film is paid out from a reel, and by performing two broad types of technique, that can be distinguished by the terms "winding" and "curtain-laying". In machines or installations which make use of the winding technique, a strip of film having a width of about 500 mm and reeled onto a card hub is installed around the load (palletized or otherwise) by making use of relative displacement between the load and moving equipment that carries the reel, with the load itself either being stationary or moving. In machines or installations that use the curtain-laying technique, a generally wider strip of film is placed across a path along which the load travels so as to form a "curtain" which is initially entrained by the load and which is subsequently closed over the load.

Examples of winding type installations are to be found in EP-096 635, whereas examples of curtain-laying installations are described in FR-2 281 275. Whatever the kind of wrapping installation used, the film is stretched in situ simultaneously or quasi-simultaneously with installation of the film itself, that is, either by tensioning the film between the load and a brake placed on the support for the film reel, or else by causing the film to run between rollers driven by motors at different circumferential speeds of rotation, as explained in the above-specified FR-2 281 275. In the winding technique, elongation of the film is limited to a value of about 80% to 100%, whereas in installations applying the curtain-laying technique, elongation can reach 200% or even more providing the loads (palletized or otherwise) are of appropriate shape, well centered on the machine, and the film-stretching device is particularly effective.

However, present machines are required to operate at high throughputs, and the speeds of rotation of a load to be wrapped, or of the reel going around the load, can reach values of about 40 revolutions per minute (rpm) to 50 rpm, but whatever kind of stretching device is implemented, such speeds prevent the film being paid out with satisfactory regularity.

Additionally, the stretching devices presently implemented on machines having motor-driven rollers require mechanisms that are relatively complex in order to obtain satisfactory results, thereby increasing the weight of the moving parts of wrapping machines so that in order to avoid rotating excessive masses, the supply reels of film are of limited weight, thereby narrowing the time the machine can operate without it being necessary to change its supply reels of non-stretched film. In addition, the paying out speeds of the film can change considerably over a short length of time, for example, from 10 meters per minute (m/min) to 200 m/min in a few tenths of a second, such that the resulting variations in elongation frequently give rise to the film rupturing, leading to operating incidents on the machine that reduce the productivity thereof, which productivity is also affected by the fact that the operators of the machines then generally slow them down or reduce the stretching percentage below that which could actually be obtained, with the result that more film-forming material is consumed.

In an attempt to mitigate the above drawbacks, and to enjoy the advantages associated with pre-stretching the wrapping film, FR-A-2 579 577 (which mentions the difficulties encountered in achieving full pre-stretching of the films which can be as much as about 300%) recommends a wrapping machine for performing pre-stretching of a film in two stages that are separated by an extremely short rest time (of the order of a few hundredths of a second). Although such a solution is advantageous in that it enables large pre-stretch ratios to be achieved, it is complex to implement and does not simplify the machines for implementing it, but on the contrary, it makes the machines more complex.

DE-3 409 117 relates to a method of wrapping loads by means of a stretchable film installed after it has been pre-stretched, and in which the film is paid out from a spool or the like on which it is stored in the pre-stretched state, and thus does not provide any real solution to the drawbacks mentioned insofar as the elongation it proposes is limited to about 50%.

The problem thus arises of providing a method of wrapping loads in stretchable film which, while taking full advantage of the great cold stretchability of the films of thermoplastic material that are suitable for use in methods and machines for wrapping loads, does not suffer from the above-mentioned drawbacks of the method in the last-mentioned patent.

OBJECTS AND SUMMARY OF THE INVENTION

In general terms an object of the invention is to provide a solution to the above identified problem.

Another object of the invention is to provide a method of wrapping loads by means of a stretchable film, and a machine and a film for implementing the method, enabling considerable simplification to be achieved in the wrapping machines, and as a result enabling the cost thereof to be reduced.

Another object of the invention is to provide a method of wrapping loads by means of a stretchable film, and a machine and a film for implementing the method, which, while leading to improved quality of the resulting wrapping, makes it possible to obtain such quality with considerable savings in wrapping material.

Another object of the invention is to provide such a method, machine, and film for implementing it, enabling the reliability of the machines used to be increased, improving their throughput, and the amount of wrapping they can perform without being reloaded, that is, improving their operation in general, with the consequence of improving industrial and economic profitability compared with conventional machines.

Another object of the invention is to provide such a method, machine, and film for implementing it, suitable for use on loads that are fragile and varied.

Finally, an object of the invention is to provide such a method, machine, and film for implementing it, in which, in use, not only are presently-enforced regulations concerning working conditions satisfied, but also operators of the machines are provided with improved working conditions and safety conditions.

The present invention provides a method of wrapping loads of items grouped together to constitute a bundle which may be palletized or otherwise, by means of stretchable film that is put into place around the bundle and, where appropriate, a pallet, after the film has been pre-stretched and paid out from a spool or the like on which it is stored in the pre-stretched state, the method being characterized in that the film is pre-stretched to an elongation value of about 150% to 500% and so that, after relaxation, it presents a tension in the spool lying in the range of 2 to 7 and preferably in the range of 2 to 3 decaNewtons per square millimeter (daN/mm$^2$) of film section per turn.

The method of the invention makes it possible firstly to perform stretching of the material under the best possible conditions insofar as the stretching and pay out speeds are no longer tied to the large variations that exist in machines where stretching takes place on the machine itself, and makes it possible secondly:

to improve the regularity in the thickness of the stretched film, associated with excellent transparency of the film;

to relax the film between the stretching stage and the stage in which it is wrapped on the bundle (with a time interval between the two stages that may be at least several minutes long), with the result that the material stabilizes between stretching and wrapping, thereby increasing the resistance of the used material to tearing and to puncturing;

to reduce strip width due to the film being stretched; this no longer takes place at the outlet of the stretching device of the machine, as occurs in known machines, but during the preceding stage which is specifically performed off the machine;

to simplify considerably machines for wrapping film on bundles, such as loads that are palletized or otherwise, since such machines no longer need to be fitted with the stretching devices of the prior art;

to select film pre-stretching to take place in the longitudinal direction and/or in the transverse direction;

to improve performance with respect to film stretch percentage due to the regularity of stretching speeds; and to feed a set of spools from a single pre-stretching station, with the spools being intended for installation on a plurality of machines or apparatus for placing the film on bundles.

The invention also provides a machine for wrapping loads of items grouped together in a bundle that may be palletized or otherwise, by means of stretchable film that is put into place around the bundle and, where appropriate a pallet, the machine being characterized in that it includes reception means for receiving a spool or the like that has a substantially cylindrical skirt and chamfered ends and on which the wrapping film is stored in the pre-stretched state, to the exclusion of additional means for stretching the film.

A machine of the invention is also characterized in that it further comprises means for supporting prepared spools of pre-stretched film and transfer means for transferring the spools to the reception means from which the film stored in the pre-stretched state is paid out.

In a preferred embodiment of a machine of the invention, the machine is of the rotating ring type, that is, of the type having a stationary bundle with means for supporting the spool of film that is stored in the pre-stretched state being provided on the rotating ring.

In another embodiment, the machine is of the "rotating arm" type.

In yet another embodiment, the machine is of the "rotating load" type.

In yet another variant, the machine is of the "curtain" type.

The invention also provides spools or the like for storing pre-stretched wrapping film for loads grouped together to constitute a bundle and that may be palletized or otherwise, and in particular the invention extends to spools characterized in that the pre-stretched film they carry is elongated by 150% to 500%, and, after relaxation, presents tension lying in the range of 2 to 7, and preferably in the range of 2 to 3 decaNewtons per square millimeter (daN/mm$^2$) of film section per turn.

BRIEF DESCRIPTION OF THE DRAWINGS

Other characteristics and advantages of the invention will appear from the following description given by way of example and made with reference to the accompanying drawings, in which like reference characters designate like or corresponding parts throughout the several views and wherein.

DETAILED DESCRIPTION OF THE ILLUSTRATED EMBODIMENTS

Although proposals have long been made to use a film of stretchable plastic material for wrapping bundle-forming loads, for example loads that are palletized or otherwise, the efforts put forth toward making as much use as possible of the stretch capacity of the film, not only for the purpose of imparting better strength properties to the wrapping but also for the purpose of achieving materials saving, have either not been entirely successful or else have achieved success only at the cost of great complication, and this has been because development has been mainly directed toward improving the wrapping machines, be they of the "winding" type (with a bundle that is stationary or moving) or machines of the "curtain" type.

Avoiding that line of development, the Applicant has devised a method that is suitable for being implemented on a wide variety of machine types and in which, in order to optimize pre-stretching of the film for wrapping loads that are grouped together in bundles that may be palletized or otherwise, the film is paid out from a spool or the like on which it is stored in the pre-stretched state, and with a very large amount of elongation so that after relaxation it presents tension lying in the range 2 to 7 and preferably in the range of 2 to 3 decaNewtons per square millimeter (daN/mm$^2$) of film section per turn.

Such a method in which the step of pre-stretching the film is dissociated from the step of installing it on the bundle thus makes it possible to perform pre-stretching under optimum conditions, with stretching and pay out speeds no longer being tied to the parameters associated with installing the film on the bundle, and in particular to the very large variations in film pay out rate required from an ordinary reel.

Figure 1:
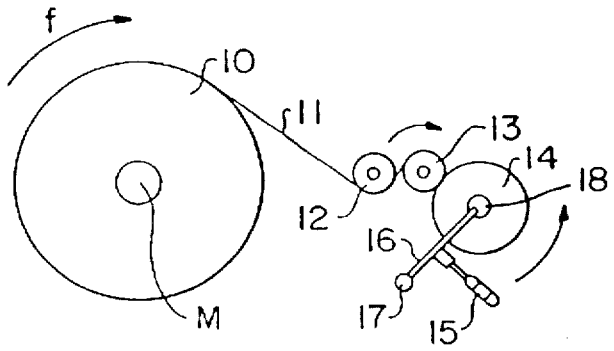
FIG. 1 is a diagrammatic plan view of a unit for fabricating spools of the invention.

Consequently, according to the invention, a reel 10 of stretchable film, for example a film of low density polyethylene or a film of linear low density polyethylene as produced by blow-extrusion or by calendaring (and which is delivered in strips having a width lying in the range of 200 mm to 1,500 mm), is placed on a vertical mandrel M so as to enable the film to be paid out by rotating the spool 10 in the direction of arrow f in FIG. 1. The film 11 is caused to travel around two rubber coated or padded rollers 12 and 13 that are driven at different circumferential speeds and is received on a mandrel 18 that is of generally cylindrical shape (FIG. 2) for the purpose of forming a spool 14 which is rotated by the roller 13 against which it is pressed with considerable force that is adjustable by means of an actuator 15 that actuates a lever arm 16 having one end pivotally mounted about an axis 17 and whose other end bears against the axis of the mandrel 18.

Because of the different circumferential speeds of the rollers 12 and 13 in a ratio that is adjustable from 1:2 to 1:6 (the roller 13 having a higher circumferential speed than the roller 12), the film 11 is stretched to a considerable extent as a function of the speed ratio of the rollers. The rollers may either be driven by motors and be connected to each other by a set of gears, or a speed reducer, or else each of them may be connected to its own motor, the first being of fixed speed and the second of adjustable speed, so that whichever embodiment is used, it is possible to obtain a spool 14 of pre-stretched film that does not unroll all on its own after the spool has been fabricated because of the slightly sticky effect of the film which is rolled up on the mandrel 18.

Figure 2:
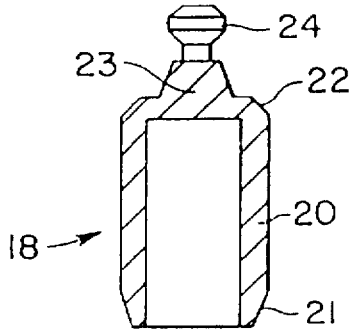
FIG. 2 is a longitudinal section view through a spool mandrel.

To ensure that the mandrel 18 is not crushed by the high pressure that results from the stretched turns under mechanical tension superposed thereon, the invention provides for making it as shown in FIG. 2, that is in the form of a substantially cylindrical skirt 20 having a wall of thick card, of aluminium, or of plastic material, and whose ends are chamfered, as shown at 21 and 22, with a centering cone 23 at the end opposite from the open edge of the skirt and an abutment 24 adjacent to the cone 23. The presence of the chamfers 21 and 22 accommodates a small excess thickness of film 11 on the edges of the mandrel 18 in the travel direction, with such excess thickness being due to the film creeping during stretching and which would accumulate in the absence of the ends of the skirt 20 being given a special shape.

Figure 3:
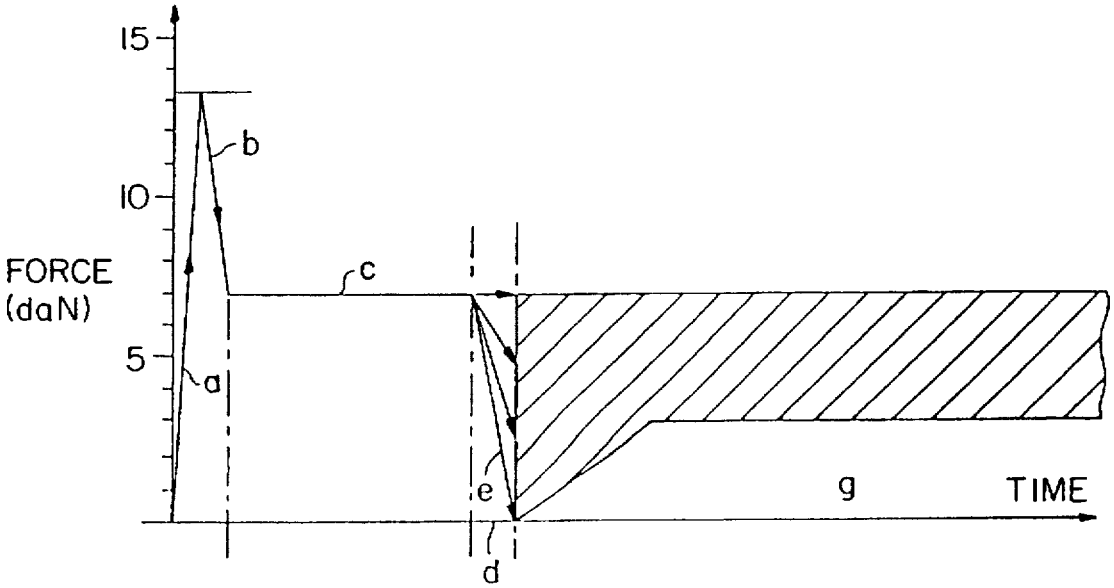
FIG. 3 is an explanatory graph.

Stretching is advantageously performed in the manner shown diagrammatically in FIG. 3 (where the abscissa is the time axis and the ordinate is the axis of stretch forces and of cohesion of a stretchable film) for the particular case of a 500 mm wide film of low density polyethylene having a thickness before stretching of 23 μm. For such a film which, by way of example only, is progressively stretched to be elongated by 150% (that is an initial sample of 100 mm has a stretched length of 250 mm) the procedure is initially to apply traction force progressively from 0 daN to 12 daN (for an elongation of 0% to 80%), followed by a force of 12 daN to 13 daN for a subsequent elongation of 80% to 150% (stage a). This is followed by a relaxation stage (stage b), at the end of which the force is 6 daN to 7 daN (which represents the film tension per turn in the spool). This force is also the holding force applied to the bundle during transport and storage, and it is known in practice as the "cohesion" force. Such a force is maintained for as long as the spool is not used (stage c), and is then used to advantage when the spool is applied to a wrapping machine and the film is braked between a value lying between 0 and the aforenoted value of 6 daN to 7 daN. While the film is being put into place on the bundle, the force is modulated as a function of the bundle and as a function of the operation of the machine, as represented diagrammatically by arrows e (stage d), which stage is followed by a final stage g where the shaded portion of the graph of FIG. 3 represents the extreme values of the residual cohesion forces, lying in the range of 2 daN to 7 daN.

Figure 3A:
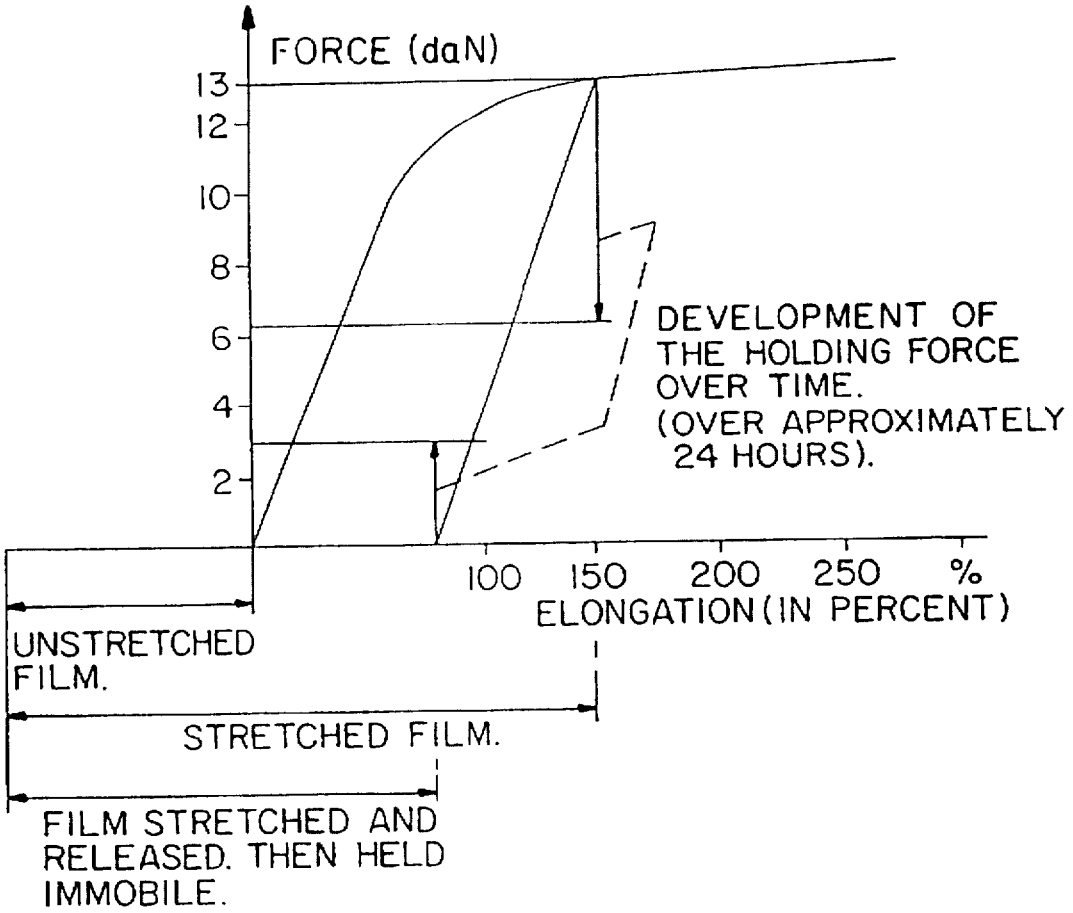
FIG. 3A is another explanatory graph.

The phenomenon of the film relaxing (also shown in FIG. 3A where the abscissa represents elongation and the ordinate represents stretching forces), and the resting of the film during stage c serve to stabilize the film and considerably increase its resistance to tearing.

The pre-stretching of the film as described above may be longitudinal and/or transversal and it may reach values of about 200% to 500% so that after relaxation the tension in the spool lies in the range of 2 to 7 and preferably in the range of 2 to 3 daN/mm$^2$ of film section per turn.

Figure 4A:
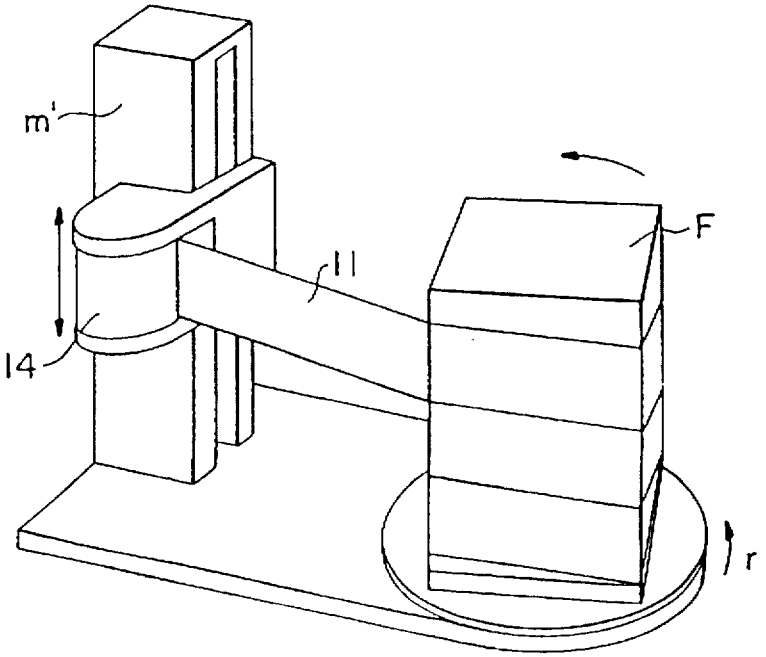
FIG. 4A is another diagrammatic perspective view of another machine of the invention.
Figure 4:
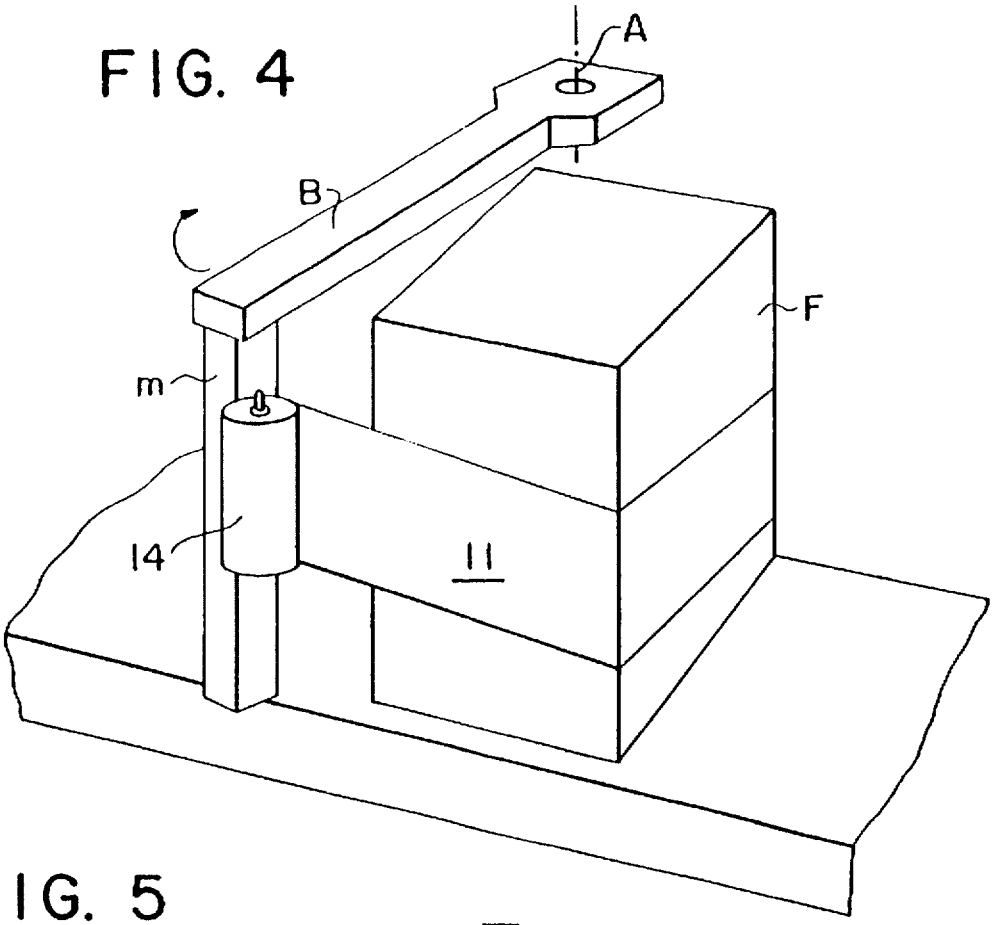
FIG. 4 is a very diagrammatic view of a machine of the invention.

The spool 14 of film pre-stretched in accordance with the invention can be used for wrapping a bundle 5 on a wide variety of types of machines. Thus, as shown in FIG. 4, the spool of pre-stretched film may be used on a "rotating arm" type machine in which the spool 14 reciprocates along an upright m while the pre-stretched film 11 is being paid out from the spool 14 and the arm B rotates about an axis A and around a bundle F constituted by loads that may be palletized or otherwise. However, in such a machine of the invention, unlike known machines, no complex stretching mechanism is provided, the presence of a simple stretching brake making it possible to modulate at will the force with which the film is applied against the load, and in the present example to a value of about 7 daN during the major portion of the cycle and then to a value in the range of 0 to 4 daN when beginning winding at the top of the load for goods that are unstable, and also during the stages in which the film is heat-sealed and cut, thereby making it particularly simple to avoid crushing fragile loads in the event of a bundle made up of such loads.

In another embodiment (FIG. 4A), the spool 14 of pre-stretched film may be used in a "rotating load" type machine in which the spool 14 reciprocates along an upright m' while the pre-stretched film 11 is paid out from the spool 14 and while the bundle F revolves as represented by arrow r if constituted by a palletized load, or is subjected to more complex rotary motion if the load is not palletized. In such a machine, and unlike known machines of the same type, no complex film stretching mechanism is provided, a simple stretching brake making it possible to modulate the force with which the film is applied against the load, as described above with reference to FIG. 4.

Figure 5:
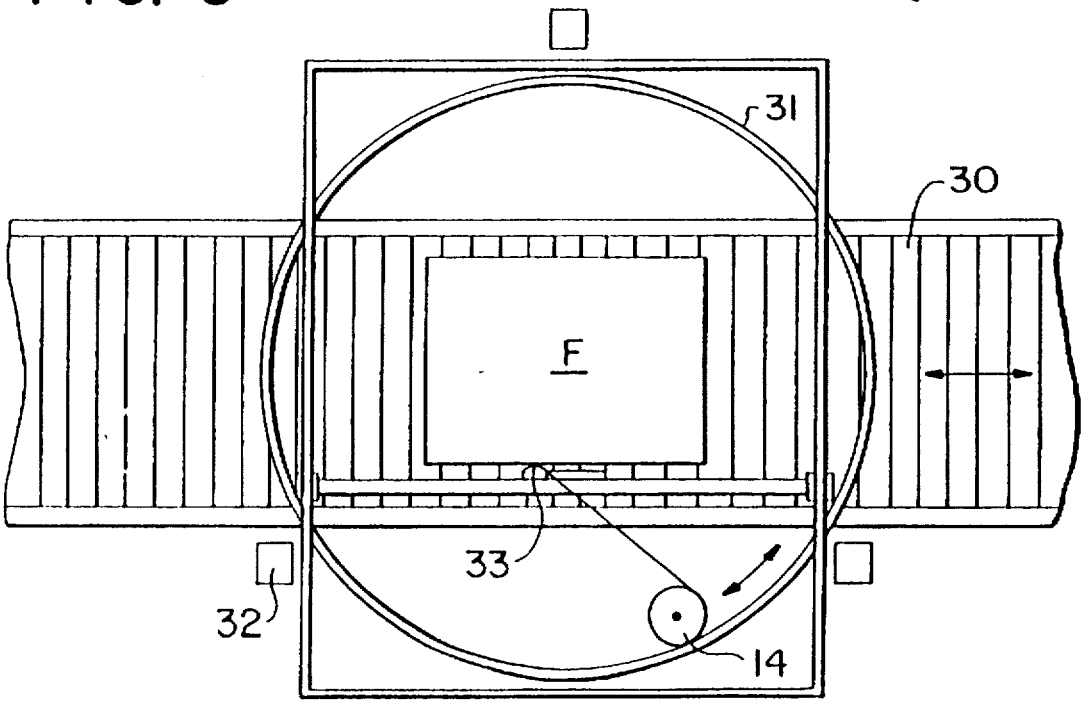
FIGS. 5 to 9 are diagrammatic perspective views of yet more machines of the invention.

In another embodiment (FIG. 5) the wrapping machine is of the type in which the bundle F is initially brought into the vicinity of the center of a rotary ring 31 by a conveyor 30 having motor-driven rollers or chains. In a machine of this type where the ring 31 is rotated by a first motor and is simultaneously subjected to vertical sliding on a frame 32 by a second motor, the invention provides for associating the spool 14 on which the pre-stretched film is stored with the ring 31 and also for controlling the paying out of the pre-stretched film from the spool 14 by means of a mechanical brake, or in a variant by a backing roller provided with a brake and bearing against one of the outside generator lines of the spool.

The use of a spool 14 of the invention on a machine of this type (and likewise on a rotating arm machine) reduces the mass of the rotating parts (thus making it possible for the ring to rotate quickly at about 20 rpm to 50 rpm) and makes it possible to apply the film properly at the bottom of the pallet without it being necessary to raise the bundle (given that the total width of the pre-stretched film on the spool has been conserved), and considerably simplifies guidance of the film between the spool and the bundle compared with the path followed in known machines of this type where mechanisms for pulling or pre-stretching the film are generally associated with the rotary ring.

Figure 6:
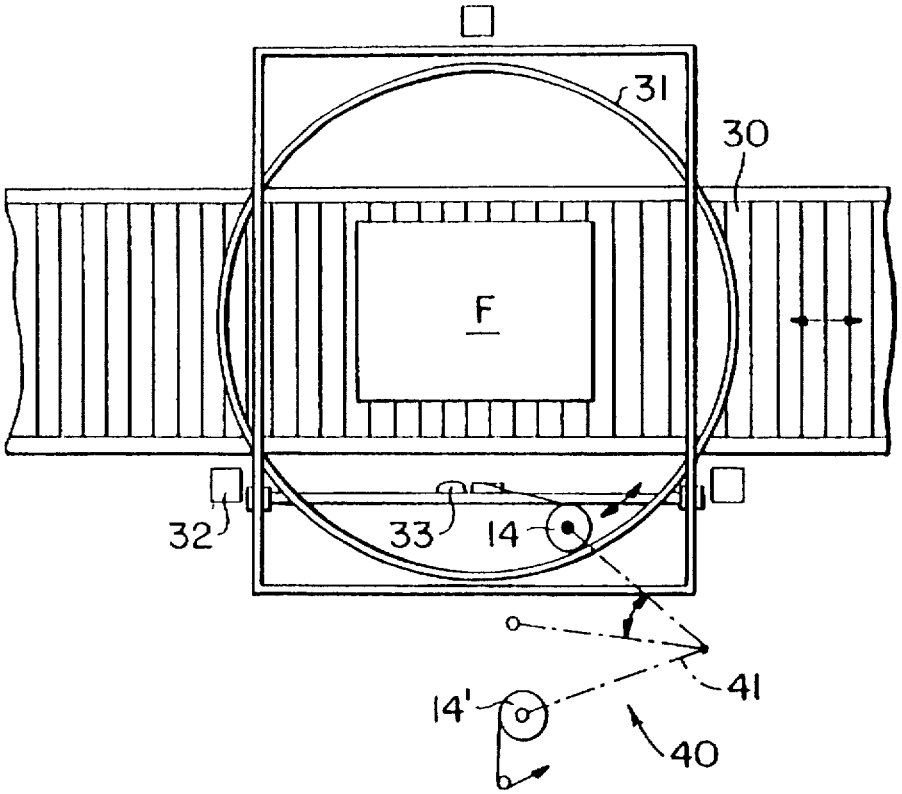

Whereas in the machine as described above the spool 14 is installed directly by an operator on the rotary ring 31 which is associated with a clamp device 33 for performing heat-sealing at the end of a cycle of the pre-stretched film as paid out from the spool 14 and also for cutting the film and re-applying it on successive loads, a machine of the same type can be provided with a device 40 (FIG. 6) that includes means making use of a transfer arm 41 for installing a previously-prepared spool 14' on the ring 31 once the spool from which pre-stretched wrapping film is being paid out has been emptied.

Figure 7:
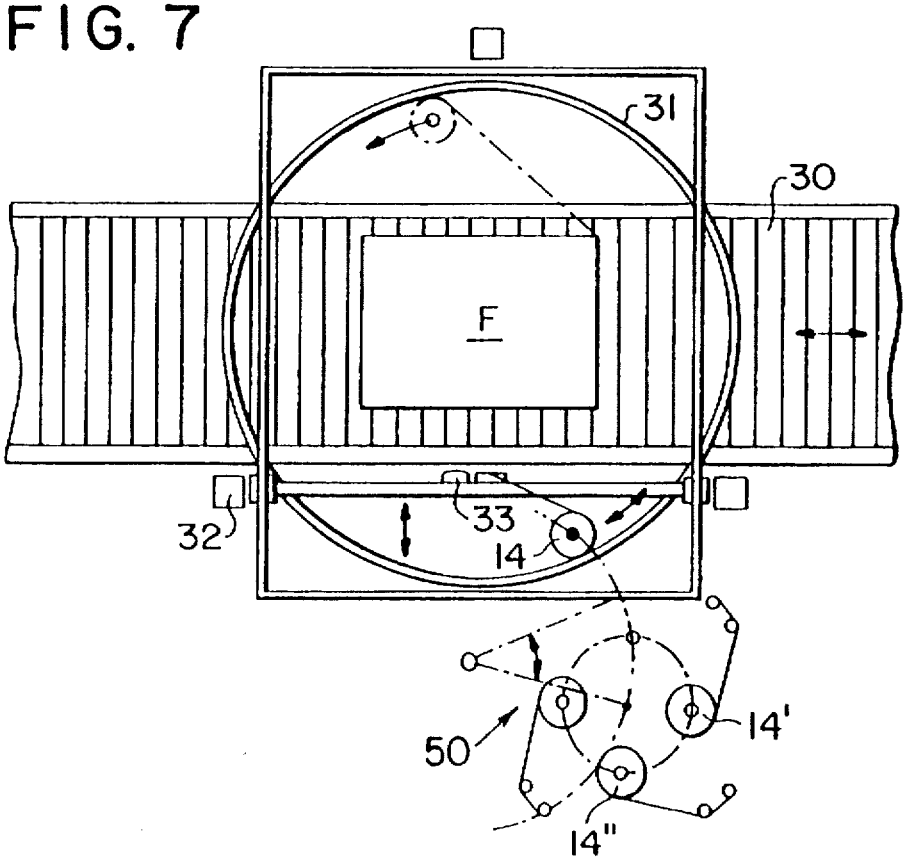
Figure 8:
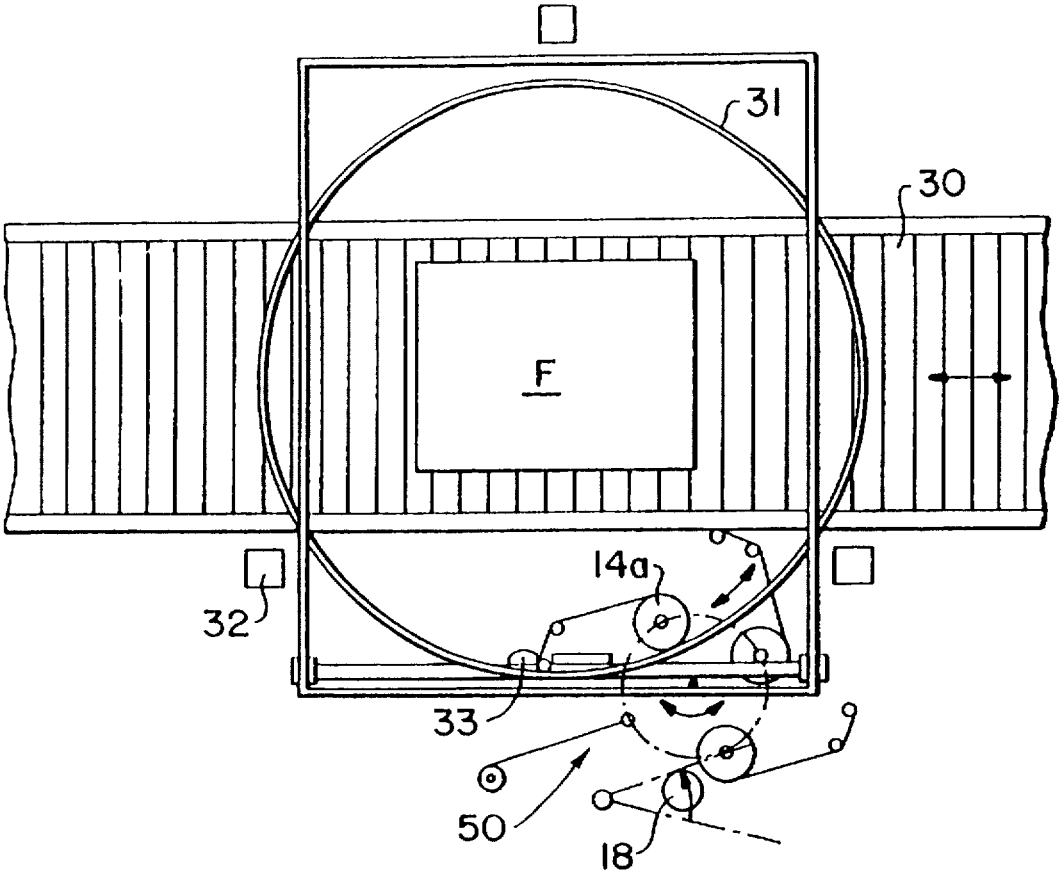

In another variant (FIGS. 7 and 8), the rotating ring wrapping machine 31 (otherwise identical to those described above) is further provided with a carousel device 50 designed to perform automatic changing of a spool 14 associated with the ring 31 from a set of prepared spools 14', 14", . . . , the condition of the machine shown in FIG. 7 being the wrapping condition whereas the condition shown in FIG. 8 corresponds to the spool being changed, the spool referenced 14*a* then in the vicinity of the clamp 33 being in the process of being loaded while an empty mandrel 18 is being discarded. It is possible to change the spool on the wrapping machine without stopping production, thereby making the machine highly flexible in operation, with operating flexibility being further improved by a device that is brought automatically into operation in the event of the end of a spool being detected or in the event of the film breaking.

Figure 9:
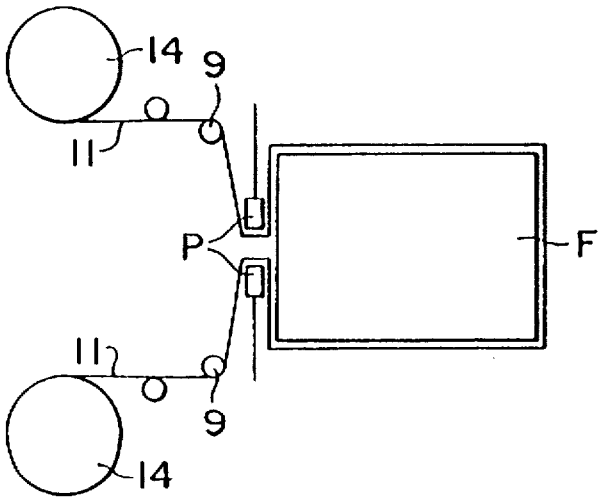

The invention is not limited to the embodiments described above. It can also be applied to wrapping loads by means of a "curtain" type machine, of the kind shown diagrammatically in FIG. 9, where the moving bundle F on a conveyor having motor-driven rollers or chains (not shown) is surrounded by the film 11 which is paid out from two spools 14. In such a machine of the invention, which does not include complex film stretching mechanisms as do known machines, a simple stretching brake and guide means q for the film 11 serves to modulate the force with which the film is applied, and the sheets dispensed from the spool 14 are suitable for being cut and united by heat-sealing jaws p.

The application of the invention to such a machine also makes it possible to adapt spools of pre-stretched film to bundles of different heights merely by modifying the transverse elongation of the film. Obviously, many modifications and variations of the present invention are possible in light of the above teachings. It is therefore to be understood that within the scope of the appended claims, the present invention may be practiced otherwise than as specifically described herein.

We claim:

1. A method of wrapping a load by means of a stretchable film that is put into place around said load, comprising the steps of:

pre-stretching said film by predetermined traction forces to an elongation value which is within the range of 150% to 500%;

relaxing said predetermined traction forces so as to relax said pre-stretched film to a predetermined degree;

subsequently winding said pre-stretched and relaxed film upon a spool so that said pre-stretched and relaxed film wound upon said spool is stabilized and exhibits a tension value upon said spool which is within the range of 2 to 7 decaNewtons per square millimeter of film section per turn; and unwinding said pre-stretched and relaxed film from said spool so as to wrap said load with said pre-stretched and relaxed film.

2. Apparatus for wrapping a load with a stretchable film that is put into place around said load, comprising:

spool means for mounting a wrapping film thereon;

means for pre-stretching said wrapping film by predetermined traction forces to an elongation value which is within the range of 150% to 500%;

means for relaxing said predetermined traction forces so as to relax said film to a predetermined degree and for subsequently winding said pre-stretched and relaxed wrapping film upon said spool means so that said pre-stretched and relaxed wrapping film wound upon said spool means is stabilized and exhibits a tension value upon said spool means which is within the range of 2 to 7 decaNewtons per square millimeter of film section per turn; and means for unwinding said pre-stretched and relaxed wrapping film from said spool means so as to wrap said load with said pre-stretched and relaxed wrapping film.

3. Apparatus according to claim 2, further comprising:

additional spools of pre-stretched and relaxed wrapping film;

means for mounting said spool means at a predetermined location with respect to said load; and means for transferring selected ones of said additional spools to said predetermined location, and for removing said spool means from said predetermined location, so as to replace said spool means with an additional one of said spools when said wrapping film disposed upon said spool means is paid out and depleted.

4. Apparatus according to claim 2, wherein:

said load is disposed at a wrapping station; and said means for unwinding said pre-stretched and relaxed wrapping film from said spool of wrapping film comprises a rotatable ring member disposed adjacent to said wrapping station, said spool of wrapping film is mounted upon said rotatable ring member, and drive means for rotating said rotatable ring member, and said spool of wrapping film mounted thereon, about said wrapping station so as to unwind said pre-stretched and relaxed wrapping film from said spool of wrapping film and and to wrap said wrapping film about said load.

5. Apparatus according to claim 2, wherein:

said load is disposed at a wrapping station; and said means for unwinding said pre-stretched and relaxed wrapping film from said spool of wrapping film comprises an arm rotatably mounted at a first proximal end thereof adjacent to said wrapping station, a shaft is fixedly mounted upon a second distal end of said arm, and said spool of wrapping film is movably mounted upon said shaft so that said pre-stretched and relaxed wrapping film disposed upon said spool is unwound from said spool of pre-stretched and relaxed wrapping film as said distal end of said arm, said shaft mounted upon said distal end of said arm, and said spool mounted upon said shaft, are rotated about said load disposed at said wrapping station.

6. Apparatus according to claim 2, wherein said means for unwinding said pre-stretched and relaxed wrapping film from said spool of pre-stretched and relaxed wrapping film comprises:

a rotatable platform disposed at a wrapping station;

said load is mounted upon said rotatable platform;

a shaft disposed adjacent to said rotatable platform;

said spool is movably mounted upon said shaft; and means for rotating said rotatable platform such that as said rotatable platform, and said load disposed thereon, is rotated, said pre-stretched and relaxed wrapping film disposed upon said spool of pre-stretched and relaxed wrapping film is unwound from said spool of pre-stretched and relaxed wrapping film and wound about said rotatable load disposed at said wrapping station.

7. Apparatus according to claim 2, wherein said means for unwinding said pre-stretched and relaxed wrapping film from said spool of pre-stretched and relaxed wrapping film comprises:

conveyor means for moving said load along a predetermined path;

a pair of spools of said pre-stretched and relaxed wrapping film disposed upon opposite sides of said predetermined path;

first and second end portions respectively provided from said pair of spools of said pre-stretched and relaxed wrapping film so as to be sealed together so as to form a curtain; and means for driving said conveyor, and said load disposed thereon, along said predetermined path such that said load will encounter said curtain formed by said sealed ends of said wrapping films from said pair of spools of wrapping film and cause said wrapping films to be unwound from said pair of spools of wrapping film and to encase said load as said load is moved along said predetermined path.

8. In combination, a spool and a film for wrapping a load, comprising:

a spool; and a wrapping film pre-stretched to an elongation value which is within the range of 150% to 500%, relaxed to a predetermined degree, and subsequently wound upon said spool such that said pre-stretched and relaxed wrapping film wound upon said spool is stabilized and exhibits a tension value upon said spool which is within the range of 2 to 7 decaNewtons per square millimeter of film section per turn.

9. The combination according to claim 8, wherein said spool has a substantially cylindrical skirt with chamfered ends.

10. The method as set forth in claim 1, wherein:

said step of relaxing said predetermined traction forces so as to relax said pre-stretched film to a predetermined degree is accomplished so that said pre-stretched and relaxed film wound upon said spool is stabilized and exhibits a tension value upon said spool which is within the range of 2 to 3 decaNewtons per square millimeter of film section per turn.

11. The method as set forth in claim 1, wherein said step of unwinding said pre-stretched and relaxed film from said spool comprises the steps of:

providing an arm which is rotatable about an axis defined at a first proximal end of said arm;

mounting a shaft upon a second distal end of said arm;

mounting said spool upon said shaft such that said spool reciprocates along said shaft; and rotating said arm about said load such that said pre-stretched and relaxed film is unwound from said spool of pre-stretched and relaxed film as said arm is rotated and said distal end of said arm, said shaft mounted upon said distal end of said arm, and said spool mounted upon said shaft are rotated about said load.

12. The method as set forth in claim 1, wherein said step of unwinding said pre-stretched and relaxed film from said spool comprises the steps of:

mounting said load upon a rotatable platform;

providing a shaft at a position adjacent to said platform;

mounting said spool of said pre-stretched and relaxed film upon said shaft such that said spool of said pre-stretched and relaxed film reciprocates along said shaft; and rotating said rotatable platform such that said pre-stretched and relaxed film disposed upon said spool of pre-stretched and relaxed film is unwound from said spool of pre-stretched and relaxed film as said load is rotated by means of said rotatable platform.

13. The method as set forth in claim 1, wherein said step of unwinding said pre-stretched and relaxed film from said spool of pre-stretched and relaxed film comprises the steps of:

disposing said load at a wrapping station;

providing a rotatable ring member at a position which is adjacent to said wrapping station;

mounting said spool of pre-stretched and relaxed film upon said rotatable ring member;;and rotating said rotatable ring member about said load such that said spool of pre-stretched and relaxed film is rotated about said load whereby said pre-stretched and relaxed film disposed upon said spool of pre-stretched and relaxed film is unwound from said spool of pre-stretched and relaxed film as said ring member and said spool of pre-stretched and relaxed film are rotated about said load.

14. The method as set forth in claim 1, wherein said step of unwinding said pre-stretched and relaxed film from said spool of pre-stretched and relaxed film comprises the steps of:

mounting said load upon a movable conveyor such that said load is moved by said conveyor along a predetermined path;

mounting a pair of spools of said pre-stretched and relaxed film upon opposite sides of said predetermined path;

sealing together end portions of said pre-stretched and relaxed films of said spools which have been unwound from said pair of spools so as to form a curtain of said pre-stretched and relaxed films disposed upon said pair of spools; and operating said conveyor so as to move said load against said curtain of said pre-stretched and relaxed film whereby said pre-stretched and relaxed films disposed upon said spools of pre-stretched and relaxed films will be unwound from said spools of pre-stretched and relaxed films so as to encase said load as said load is moved along said path by said movable conveyor.

15. Apparatus as set forth in claim 2, wherein:

said pre-stretched and relaxed wrapping film has a tension value which is within the range of 2 to 3 decaNewtons per square millimeter of film section per turn.

16. Apparatus as set forth in claim 2, wherein:

said means for pre-stretching said wrapping film comprises a pair of rollers, about which said wrapping film is caused to travel, which are driven at different circumferential speeds.

17. Apparatus as set forth in claim 16, wherein:

said circumferential speeds of said pair of rollers have a speed ratio which is within the range of 1:2 to 1:6.

18. The combination as set forth in claim 8, wherein:

said pre-stretched and relaxed wrapping film wound upon said spool has a tension value which is within the range of 2 to 3 decaNewtons per square millimeter of film section per turn.

19. A method of wrapping a load with stretchable film that is put into place around said load, comprising the steps of:

pre-stretching said film by predetermined traction forces to an elongation value which is within the range of 150% to 500%;

relaxing said predetermined traction forces so as to relax said pre-stretched film to a predetermined degree;

subsequently winding said pre-stretched and relaxed film upon a spool so that said pre-stretched and relaxed film wound upon said spool is stabilized and exhibits a tension value upon said spool which is within the range of 2 to 7 decaNewtons per square millimeter of film section per turn; and unwinding said pre-stretched and relaxed film from said spool so as to wrap said load with said pre-stretched and relaxed film.

20. A method as set forth in claim 19, wherein:

said step of relaxing said pre-stretched film wound upon said spool is accomplished so that, after said relaxation, said pre-stretched film wound upon said spool is stabilized and exhibits a tension upon said spool which is within the range of 2 to 3 decaNewtons per square millimeter of film section per turn.

21. Apparatus for wrapping a load with a stretchable film that is put into place around said load, comprising:

spool means for mounting a wrapping film thereon;

means for pre-stretching said wrapping film by predetermined traction forces to an elongation value which is within the range of 150% to 500%;

means for relaxing said predetermined traction forces so as to relax said film to a predetermined decree and for subsequently winding said pre-stretched and relaxed wrapping film upon said spool means so that said pre-stretched and relaxed wrapping film wound upon said spool means is stabilized and exhibits a tension value upon said spool means which is within the range of 2 to 7 decaNewtons per square millimeter of film section per turn; and means for unwinding said pre-stretched and relaxed wrapping film from said spool means so as to wrap said load with said pre-stretched and relaxed wrapping film.

22. Apparatus as set forth in claim 21, wherein:

said pre-stretched and relaxed wrapping film has a tension value which is within the range of 2 to 3 decaNewtons per square millimeter of film section per turn.

23. In combination, a spool and a film for wrapping a load, comprising:

a spool; and a wrapping film pre-stretched to an elongation value which is within the range of 150% to 500%, relaxed to a predetermined degree, and subsequently wound upon said spool such that said pre-stretched and relaxed wrapping film wound upon said spool is stabilized and exhibits a tension value upon said spool which is within the range of 2 to 7 decaNewtons per square millimeter of film section per turn.

24. The combination as set forth in claim 23, wherein:

said pre-stretched and relaxed wrapping film disposed upon said spool has a tension value upon said spool which is within the range of 2 to 3 decaNewtons per square millimeter of film section per turn.

* * * * *